US010760412B2

(12) United States Patent
Kaur et al.

(10) Patent No.: US 10,760,412 B2
(45) Date of Patent: Sep. 1, 2020

(54) DRILLING COMMUNICATION SYSTEM WITH WI-FI WET CONNECT

(71) Applicant: Nabors Drilling Technologies USA, Inc., Houston, TX (US)

(72) Inventors: Harmeet Kaur, Houston, TX (US); Robert Mack Ramirez, Cypress, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 43 days.

(21) Appl. No.: 15/949,517

(22) Filed: Apr. 10, 2018

(65) Prior Publication Data

US 2019/0309621 A1 Oct. 10, 2019

(51) Int. Cl.

| | |
|---|---|
| ***E21B 47/12*** | (2012.01) |
| ***E21B 47/18*** | (2012.01) |
| ***E21B 49/00*** | (2006.01) |
| ***E21B 7/04*** | (2006.01) |
| ***E21B 4/02*** | (2006.01) |
| ***E21B 17/02*** | (2006.01) |
| ***E21B 17/16*** | (2006.01) |
| *E21B 47/024* | (2006.01) |
| *E21B 47/06* | (2012.01) |

(52) U.S. Cl.

CPC ..... *E21B 47/12* (2013.01); *E21B 4/02* (2013.01); *E21B 7/04* (2013.01); *E21B 17/028* (2013.01); *E21B 17/16* (2013.01); *E21B 47/18* (2013.01); *E21B 49/003* (2013.01); *E21B 47/024* (2013.01); *E21B 47/06* (2013.01)

(58) Field of Classification Search

CPC ..... E21B 47/12; E21B 47/18; E21B 47/024; E21B 47/06; E21B 4/02; E21B 7/04; E21B 17/028; E21B 17/16; E21B 49/003

See application file for complete search history.

(56) References Cited

U.S. PATENT DOCUMENTS

| | | | |
|---|---|---|---|
| 3,333,239 | A | 7/1967 | Silverman |
| 3,590,141 | A | 6/1971 | Mildner |
| 5,160,925 | A | 11/1992 | Dailey et al. |
| 5,642,051 | A | 6/1997 | Babour et al. |
| 5,820,416 | A | 10/1998 | Carmichael |
| 6,160,492 | A | 12/2000 | Herman |
| 6,163,155 | A | 12/2000 | Bittar |
| 6,626,253 | B2 | 9/2003 | Hahn et al. |
| 6,899,178 | B2 | 5/2005 | Tubel |
| 7,064,676 | B2 | 6/2006 | Hall et al. |
| 7,080,699 | B2 | 7/2006 | Lovell et al. |
| 7,249,636 | B2 | 7/2007 | Ohmer |
| 7,477,161 | B2 | 1/2009 | Macpherson et al. |
| 7,565,936 | B2 | 7/2009 | Zhang et al. |
| 7,573,397 | B2 | 8/2009 | Petrovic et al. |

(Continued)

*Primary Examiner* — Taras P Bemko
*Assistant Examiner* — Yanick A Akaragwe
(74) *Attorney, Agent, or Firm* — Haynes and Boone, LLP

(57) ABSTRACT

Drilling communication systems employ a Wi-Fi wet connect to communicate information from one downhole subsystem to another. In some implementations, the subsystems are disposed within drilling callers making-up a bottom hole assembly (BHA). The Wi-Fi wet connect may communicate information obtained by a first downhole subsystem for storing or transmission by the second downhole subsystem.

16 Claims, 3 Drawing Sheets

(56) References Cited

U.S. PATENT DOCUMENTS

| | | | | |
|---|---|---|---|---|
| 8,164,476 | B2 | 4/2012 | Hache et al. | |
| 9,052,043 | B2 | 6/2015 | Mueller et al. | |
| 9,347,277 | B2 | 5/2016 | Taherian et al. | |
| 9,647,381 | B2 | 5/2017 | Head | |
| 9,719,345 | B2 | 8/2017 | Switzer et al. | |
| 9,761,962 | B2 | 9/2017 | Nicholson | |
| 2005/0126777 | A1 | 6/2005 | Rolovic et al. | |
| 2006/0290528 | A1 | 12/2006 | MacPherson et al. | |
| 2009/0120689 | A1 | 5/2009 | Zaeper et al. | |
| 2009/0316528 | A1* | 12/2009 | Ramshaw | E21B 44/00 367/83 |
| 2010/0213942 | A1* | 8/2010 | Lazarev | E21B 17/028 324/333 |
| 2011/0176387 | A1 | 7/2011 | Froelich | |
| 2013/0132050 | A1* | 5/2013 | Parry | G06F 7/544 703/2 |
| 2017/0216891 | A1* | 8/2017 | Campanella | B09B 1/006 |

* cited by examiner

DRILLING COMMUNICATION SYSTEM WITH WI-FI WET CONNECT

BACKGROUND OF THE DISCLOSURE

The present disclosure relates in general to two-way drilling communication systems. Particularly, the present disclosure relates to drilling communication systems utilizing a Wi-Fi wet connect to transfer information between downhole subsystems.

A bottom hole assembly (BHA) may include a plurality of different subsystems such as Measurement-While-Drilling (MWD), Logging-While-Drilling (LWD), Rotary Steerable System (RSS), and others. Each subsystem is capable of performing different tasks, such as collecting information for tracking, logging, steering, telemetry, or other purposes. These drilling subsystems operate as either an isolated subsystem or they may communicate over a conductive electrical connection allowing transmission of signals from one drilling subsystem to the other. This required electrical connection between subsystems, typically carried by separate tubular collars, may result in a complicated makeup and disassembly of components. For example, some tubular collars require precise diametrical control and alignment in order to provide a suitable mechanical connection. This challenge may be magnified when collar ends are trimmed or re-cut to accommodate for wear or other adjustments.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
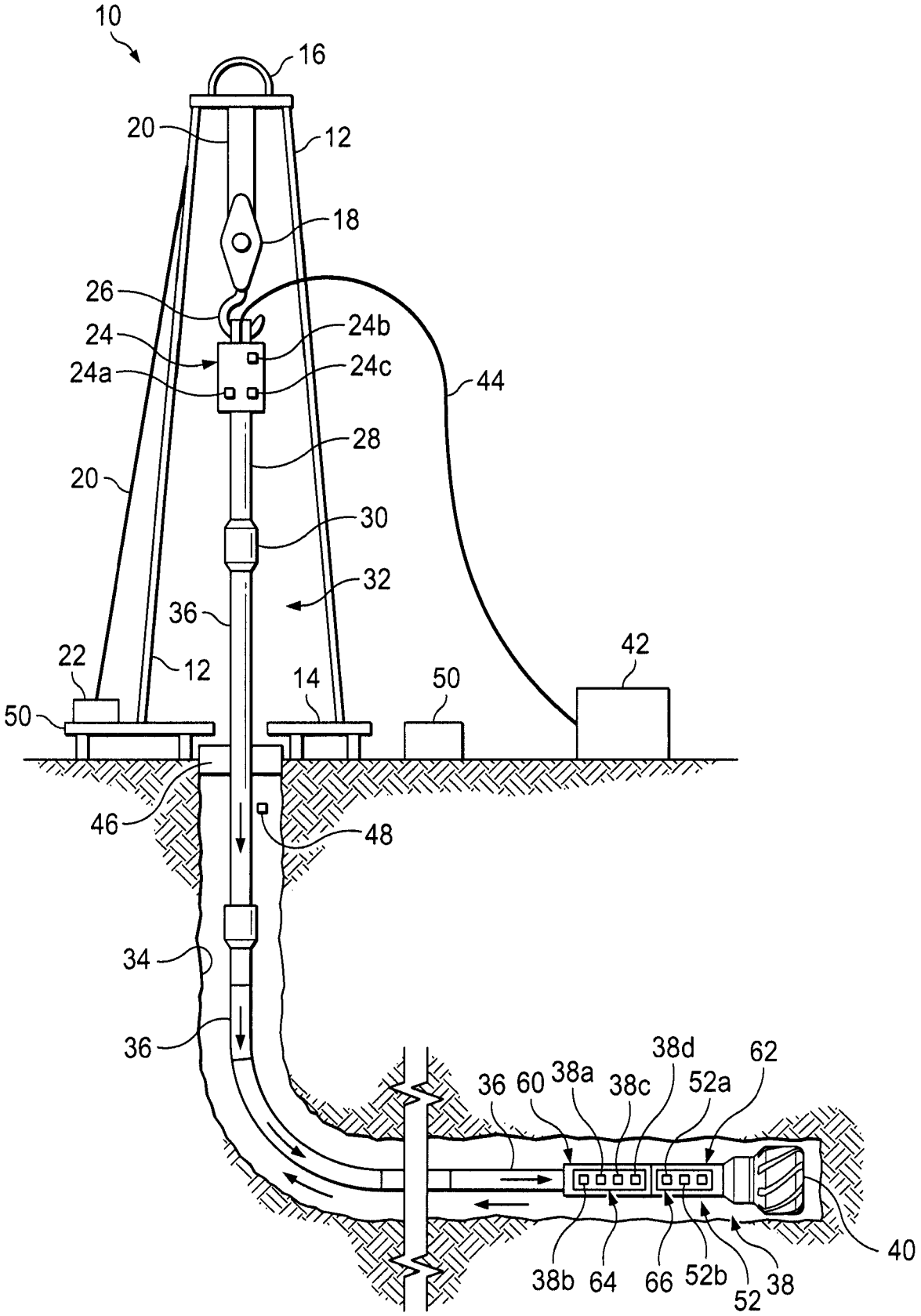
FIG. 1 is an illustration of an exemplary drilling system in a subterranean formation according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

This disclosure is directed to an improved system and method for communicating downhole information between electronically controlled subsystems during a well drilling process. In some implementations, the system and method employ a Wi-Fi wet connect that communicates information from an electronically controlled subsystem in a bottom hole assembly (BHA) to another electronically controlled subsystem in the BHA. The Wi-Fi wet connect may employ a transmitter associated with one electronically controlled subsystem with a receiver associated with the other electronically controlled subsystem. In some implementations, the transmitter and the receiver may be fixed in place relative to each other via an alignment element such as a hollow support tube and may communicate using Wi-Fi transmissions. In other implementations, the transmitter and the receiver positions may be random or unfixed relative to each other and may communicate information through the Wi-Fi transmissions. Because the BHA employs a Wi-Fi wet connect, the BHA assembly may be simplified because direct electrical contact between subsystems may no longer be required. This communication system may simplify assembly in dirty rig site environments. This system may also provide the benefit of electrical isolation while still allowing communications. In some implementations, the Wi-Fi wet connect may accommodate two-way communication between subsystems in the BHA.

Referring to FIG. 1, an exemplary embodiment of such a drilling rig (i.e., on which the drilling process is automated and optimized) is schematically illustrated and generally referred to by the reference numeral 10. The drilling rig 10 is or includes a land-based drilling system—however, one or more aspects of the present disclosure are applicable or readily adaptable to any type of drilling rig (e.g., a jack-up rig, a semisubmersible, a drill ship, a coiled tubing rig, a well service rig adapted for drilling and/or re-entry operations, and a casing drilling rig, among others). The drilling rig 10 includes a mast 12 that supports lifting gear above a rig floor 14, which lifting gear includes a crown block 16 and a traveling block 18. The crown block 16 is coupled to the mast 12 at or near the top of the mast 12. The traveling block 18 hangs from the crown block 16 by a drilling line 20. The drilling line 20 extends at one end from the lifting gear to drawworks 22, which drawworks are configured to reel out and reel in the drilling line 20 to cause the traveling block 18 to be lowered and raised relative to the rig floor 14. The other end of the drilling line 20 (known as a dead line anchor) is anchored to a fixed position, possibly near the drawworks 22 (or elsewhere on the rig).

The drilling rig 10 further includes a top drive 24, a hook 26, a quill 28, a saver sub 30, and a drill string 32. The top drive 24 is suspended from the hook 26, which hook is attached to the bottom of the traveling block 18. The quill 28 extends from the top drive 24 and is attached to a saver sub 30, which saver sub is attached to the drill string 32. The drill string 32 is thus suspended within a wellbore 34. The quill 28 may instead be attached directly to the drill string 32. The term "quill" as used herein is not limited to a component which directly extends from the top drive 24, or which is otherwise conventionally referred to as a quill 28. For example, within the scope of the present disclosure, the "quill" may additionally (or alternatively) include a main shaft, a drive shaft, an output shaft, and/or another component which transfers torque, position, and/or rotation from the top drive 24 or other rotary driving element to the drill string 32, at least indirectly. Nonetheless, albeit merely for the sake of clarity and conciseness, these components may be collectively referred to herein as the "quill."

The drill string 32 includes interconnected sections of drill pipe 36, a bottom-hole assembly ("BHA") 38, and a drill bit 40. The BHA 38 may include a plurality of drilling collars 60, 62 that include one or more electronically controlled subsystems 64, 66. These subsystems 64, 66 may include for example, measurement-while-drilling ("MWD"), logging-while-drilling ("LWD"), mud motors, rotary steerable systems ("RSS"), wireline conveyed instruments, among other electronically controlled subsystems. The drill bit 40 is connected to the bottom of the BHA 38 or is otherwise attached to the drill string 32. One or more mud pumps 42 deliver drilling fluid to the drill string 32 through a hose or other conduit 44, which conduit may be connected to the top drive 24. The downhole electronically controlled subsystems 64, 66 may be configured for the detection and/or evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 32, electronic transmission through a wireline or wired pipe, and/or transmission as electromagnetic pulses. The electronically controlled subsystems and/or other portions of the BHA 38 may have the ability to store measurements for later retrieval via wireline and/or when the BHA 38 is tripped out of the wellbore 34.

The drilling rig 10 may also include a rotating blow-out preventer ("BOP") 46, such as if the wellbore 34 is being drilled utilizing under-balanced or managed-pressure drilling methods. In such an embodiment, the annulus mud and cuttings may be pressurized at the surface, with the actual desired flow and pressure possibly being controlled by a choke system, and the fluid and pressure being retained at the well head and directed down the flow line to the choke system by the rotating BOP 46. The drilling rig 10 may also include a surface casing annular pressure sensor 48 configured to detect the pressure in the annulus defined between, for example, the wellbore 34 (or casing therein) and the drill string 32. In the embodiment of FIG. 1, the top drive 24 is utilized to impart rotary motion to the drill string 32. However, aspects of the present disclosure are also applicable or readily adaptable to implementations utilizing other drive systems, such as a power swivel, a rotary table, a coiled tubing unit, a downhole motor, and/or a conventional rotary rig, among others.

The drilling rig 10 also includes a control system 50 configured to control or assist in the control of one or more components of the drilling rig 10—for example, the control system 50 may be configured to transmit operational control signals to the drawworks 22, the top drive 24, the BHA 38 and/or the mud pump(s) 42. The control system 50 may be a stand-alone component installed anywhere on or about the drilling rig 10. In some embodiments, the control system 50 includes one or more systems located in a control room proximate the drilling rig 10, such as the general purpose shelter often referred to as the "doghouse" serving as a combination tool shed, office, communications center, and general meeting place. The control system 50 may be configured to transmit the operational control signals to the drawworks 22, the top drive 24, the BHA 38, and/or the mud pump(s) 42 via wired or wireless transmission (not shown). The control system 50 may also be configured to receive electronic signals via wired or wireless transmission (also not shown) from a variety of sensors included in the drilling rig 10, where each sensor is configured to detect an operational characteristic or parameter. The sensors from which the control system 50 is configured to receive electronic signals via wired or wireless transmission (not shown) may include one or more of the following: a torque sensor 24*a*, a speed sensor 24*b*, a WOB sensor 24*c*, a downhole annular pressure sensor 38*a*, a shock/vibration sensor 38*b*, a toolface sensor 38*c*, a WOB sensor 38*d*, the surface casing annular pressure sensor 48, a mud motor delta pressure ("ΔP") sensor 52*a*, and one or more torque sensors 52*b*.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data. The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the drilling rig 10.

The drilling rig 10 may include any combination of the following: the torque sensor 24*a*, the speed sensor 24*b*, and the WOB sensor 24*c*. The torque sensor 24*a* is coupled to or otherwise associated with the top drive 24—however, the torque sensor 24*a* may alternatively be located in or associated with the BHA 38. The torque sensor 24*a* is configured to detect a value (or range) of the torsion of the quill 28 and/or the drill string 32 in response to, for example, operational forces acting on the drill string 32. The speed sensor 24*b* is configured to detect a value (or range) of the rotational speed of the quill 28. The WOB sensor 24*c* is coupled to or otherwise associated with the top drive 24, the drawworks 22, the crown block 16, the traveling block 18, the drilling line 20 (which includes the dead line anchor), or another component in the load path mechanisms of the drilling rig 10. More particularly, the WOB sensor 24*c* includes one or more sensors different from the WOB sensor 38*d* that detect and calculate weight-on-bit, which can vary from rig to rig (e.g., calculated from a hook load sensor based on active and static hook load).

Further, the drilling rig 10 may additionally (or alternatively) include any combination of the following disposed as a part of the electronically controlled subsystem 64 disposed on or forming a part of the drilling collar 60 forming a part of the BHA 38: the downhole annular pressure sensor 38*a*, the shock/vibration sensor 38*b*, the toolface sensor 38*c*, and the WOB sensor 38*d*. Other sensors may be included depending on the type of subsystem used. The downhole annular pressure sensor 38*a* is coupled to or otherwise associated with or forms a part of the electronically controlled subsystem 64 of the BHA 38, and may be configured to detect a pressure value or range in the annulus-shaped region defined between the external surface of the BHA 38 and the internal diameter of the wellbore 34 (also referred to as the casing pressure, downhole casing pressure, MWD casing pressure, or downhole annular pressure). Such measurements may include both static annular pressure (i.e., when the mud pump(s) 42 are off) and active annular pressure (i.e., when the mud pump(s) 42 are on). The shock/vibration sensor 38*b* is configured for detecting shock and/or vibration in the BHA 38. The toolface sensor 38*c* is configured to detect the current toolface orientation of the drill bit 40, and may be or include a magnetic toolface sensor which detects toolface orientation relative to magnetic north or true north. In addition, or instead, the toolface sensor 38*c* may be or include a gravity toolface sensor which detects toolface orientation relative to the Earth's gravitational field. In addition, or instead, the toolface sensor 38*c* may be or include a gyro sensor. The WOB sensor 38*d* may be integral to the BHA 38 and is configured to detect WOB at or near the BHA 38.

Additionally, the drilling rig 10 may additionally (or alternatively) include any combination of the following disposed as a part of the electronically controlled subsystem 66 adjacent to or forming a part of the drilling collar 62 of the BHA 38: the mud motor ΔP sensor 52*a* and the torque sensor(s) 52*b*. Additional sensors may be used depending on the type of subsystem. The mud motor ΔP sensor 52*a* is configured to detect a pressure differential value or range across one or more motors 52 of the BHA 38 and may comprise one or more individual pressure sensors and/or a comparison tool. The motor(s) 52 may each be or include a positive displacement drilling motor that uses hydraulic power of the drilling fluid to drive the drill bit 40 (also known as a mud motor). The torque sensor(s) 52*b* may also be included in the electronically controlled subsystem 66 for sending data to the control system 50 that is indicative of the torque applied to the drill bit 40 by the one or more motors 52.

As noted, the sensors may be dependent upon the type of electronically controlled subsystems 64, 66 utilized on the BHA 38. For example, some BHA's may utilize particular subsystems with fewer or more sensors arranged to detect different types of downhole parameters. An RSS electronically controlled subsystem may sense other parameters. Some sensors may detect parameters of the borehole, while others detect parameters relating to the operation of the BHA itself. Others may yet to detect information relating to the subterranean formations through which the BHA passes.

Figure 2:
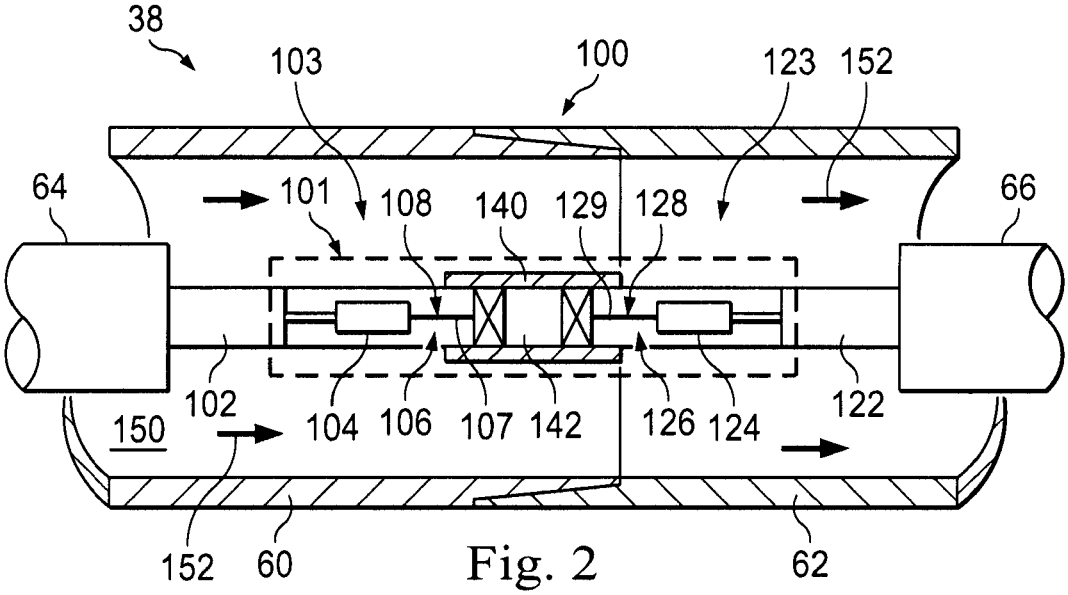
FIG. 2 is an illustration of a partial cross-sectional view of an exemplary drilling communication system according to one or more aspects of the present disclosure.

FIG. 2 shows additional details of a portion of the BHA 38 including a drilling communication system 100. The drilling communication system 100 is configured and arranged to communicate information over a Wi-Fi enabled wet connect 101. The Wi-Fi wet connect 101 provides communication between the electronically controlled subsystem 64 associated with the collar 60 and the electronically controlled subsystem 66 associated with the collar 62. In this implementation, the electronically controlled subsystem 64 includes a conductor 102 and a wireless communication link 103. The wireless communication link 103 may include a printed circuit board 104, and a receiver 106 including an antenna 108. In this implementation, a coaxial cable 107 forms a part of the antenna 108. In some implementations, the antenna 108 may be disposed directly on the printed circuit board 104. In some examples, the antenna 108 may be a trace on the printed circuit board 104. The drilling communication system 100 also includes the electronically controlled subsystem 66, which includes a conductor 122 and a wireless communication link 123. The wireless communication link 123 may include a printed circuit board 124 and a transmitter 126 that may also include a transmission antenna 128. In some implementations, printed circuit board 124 and the transmission antenna 128 are connected via a coaxial cable 129. In this implementation, the transmission antenna 128 is spaced from the printed circuit board 124 by the coaxial cable 129. In some implementations, the coaxial cable 129 forms a part of the transmission antenna 128. However, in some implementations, the transmitter 126 forms a part of or is disposed on the printed circuit board 124. This implementation includes a 1-way transmitting circuit from the electronically controlled subsystem 66 to the electronically controlled subsystem 64. However, other implementations include a 2-way transmitting circuit for two-way communication between the electronically controlled subsystem 66 and the electronically controlled subsystem 64. In such examples, rather than each electronically controlled subsystem having either a receiver or a transmitter, each electronically controlled subsystem instead includes both a receiver and a transmitter, as does a transceiver. Accordingly, each electronically controlled subsystem would then be able to both transmit and receive communications.

In the implementation described, the wireless communication occurs via Wi-Fi transmitted from one electronically controlled subsystem to the other. Because of the wireless communication, electrical point contact may be unnecessary, making assembly of the BHA easier and possibly making communication more reliable than in designs requiring point-to-point physical contact. As used herein, Wi-Fi is intended to encompass transmissions emitted and received in the 2.4 GHz frequency range. In some implementations, Wi-Fi may include RF signals transmitted at frequencies much lower, including frequencies in a range of about 0.001 GHz and 0.0055 GHz. In some implementations, the Wi-Fi transmissions may be transmitted at frequencies greater than 0.0055 GHz. In some implementations, the Wi-Fi transmissions may be transmitted at frequencies between 0.0055 GHz and 0.030 GHz. in some implementations, the Wi-Fi transmissions may be transmitted at very high frequency (VHF), ultra high frequency (UHF), or superhigh frequency (SHF) ranges. In some implementations, VHF transmissions may have RF in a range from 0.030 GHz to 0.3 GHz. UHF transmissions may have RF in a range from 0.300 GHz to 3 GHz. SHF transmissions may have RF in a range from 3 GHz to 30 GHz. This is substantially different than electromagnetic transmissions used to transmit data through the earth to antenna receivers. These through-the-earth transmissions typically employ low-frequency electromagnetic signaling having frequencies in about the 1 Hz to 5 Hz range. Accordingly, communication between subsystems of the BHA occur via wireless Wi-Fi communication.

In some implementations, including the one shown, the Wi-Fi wet connect 101 may include an optional alignment element 140 associated with the wireless communication link 103 and the wireless communication link 123. In some embodiments, the alignment element 140 may be a hollow metal tube configured to receive a portion of the communication link 103 in one end and the communication link 123 in the other end. The tube is not used for electrically conductive purposes, but may be used to secure components of the Wi-Fi wet connect 101 in place. For example, the tube may secure communication link 103 in a fixed position relative to the communication link 123. The communication links 103 and 123 may be disposed within the alignment element 140 to create a gap 142 there between. In some implementations, the gap 142 may contain or may be filled with air to allow communication to occur through an air medium from the transmitter 126 to the receiver 106. The air or any RF transparent material may be sealed within the alignment element. In other implementations, the gap 142 may be filled with alternative fluids, such as a liquid. The RF signals of the Wi-Fi wet connect may be transmitted through the fluid medium from the transmitter 126 to the receiver 106. In some implementations, the alignment element 140 may include seals or liquid stops to prevent ingress and egress of fluids into the gap 142 between the transmitter 126 and the receiver 106. In some implementations, the seals, which may be O-rings, may be disposed along an inner surface of the alignment element and may seal against an outer surface of the communication links 103, 123, or the conductors 102, 122. In some implementations, the alignment element 140 is a rigid metal tube.

In the embodiment shown, the wireless communication links 103, 123 are disposed within the hollow interior or lumen 150 of the drilling collars 60, 62. As known in the art, drilling fluids such as pressurized drilling mud may flow through the lumen of the drilling collars 60, 62 in order to drive or power the motor of the BHA. The drilling fluid flow is represented by the arrows 152. Some implementations of the alignment element 140, prevent drilling mud, fluid, or other debris from interfering with the wireless communication pathway between the transmitter 126 and the receiver 106.

Figure 3:
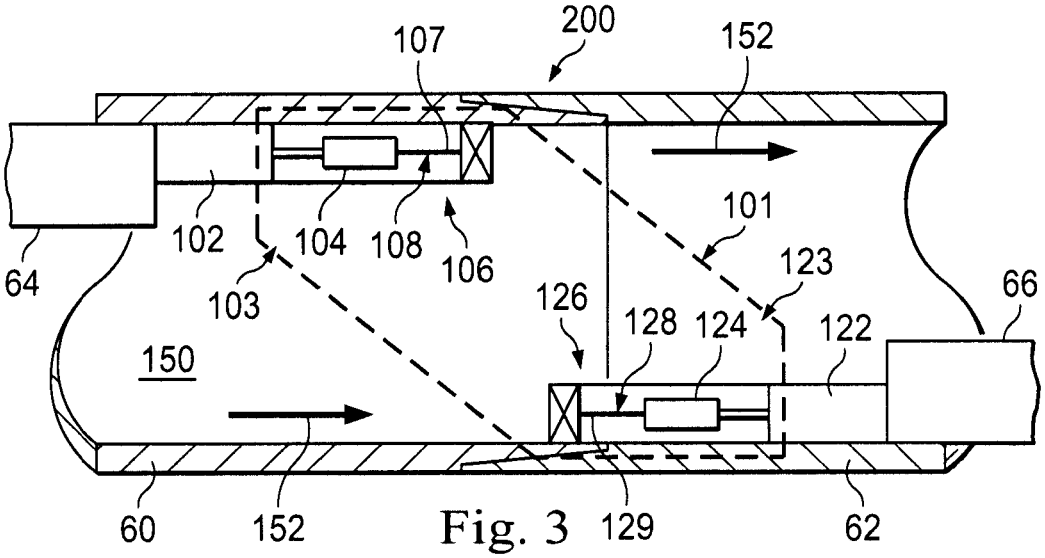
FIG. 3 is an illustration of a partial cross-sectional view of another exemplary drilling communication system according to one or more aspects of the present disclosure.

FIG. 3 shows an additional drilling communication system, referenced herein by the numeral 200. The drilling communication system 200 is similar in many ways to the drilling communication system 100, but does not include an alignment element that secures the receiver 106 in a fixed position relative to the transmitter 126. Instead, the receiver 106 and the transmitter 106 are not fixed relative to each other and may be disposed anywhere within the lumen 150 of their respective collars. In some implementations, the receiver 106 may be disposed against an inner wall of the collar 60, and the transmitter 126 may be disposed against an inner wall of the collar 62. When the collar 60 is threaded onto the collar 62, the radial location of the receiver 106 and the transmitter 126 may not need to be tracked because the Wi-Fi wet connect may communicate effectively whether the receiver and transmitter are aligned or misaligned. However, because of the Wi-Fi transmission, the relative location of the receiver 106 to the transmitter 126 does not disrupt or inhibit communication between the electronically controlled subsystem 64 and the electronically controlled subsystem 66. This may simplify assembly of the BHA by allowing collars containing different electronically controlled subsystems to be threaded together during assembly without regard for whether the receiver 106 and the transmitter 126 are aligned for communication. This may simplify BHA set up, thereby saving time and increasing the efficiency of the overall rig set up or takedown.

The electronically controlled subsystem 64, 66 may be any system relied upon for communication down hole. Accordingly, the Wi-Fi wet connect may be used to communicate, for example, between two electronically controlled subsystems that are not electronically communicating with the surface control system. In some implementations, the electronically controlled subsystem 64 is an MWD tool configured to send communication signals received to the surface in a manner known in the art. In some implementations, the MWD tool uses mud pulse telemetry to communicate information detected itself or by the electronically controlled subsystem 66. In one example implementation, the electronically controlled subsystem 64 is an MWD tool and the electronically controlled subsystem 66 is an RSS controllable to steer the distal end of the drill string. Information relating to the RSS or detected by sensors on the RSS may be communicated from the transmitter 126 to the receiver 106 so that the MWD tool can communicate the information via mud pulse telemetry to the surface. In another example implementation, the electronically controlled subsystem 64 is an MWD tool and the electronically controlled subsystem 66 is a LWD tool. This may operate in the same way, with the LWD tool communicating via Wi-Fi connection with the MWD tool and the MWD tool transmitting via mud pulse telemetry or some other method to the surface. In some implementations, the MWD tool may store or process some information received from the LWD tool or from the RSS. This stored data may be retrieved from the MWD after being tripped to the surface. Although not shown in this implementation, the collar shown may include a chassis formed therein for stabilizing and holding the electronically controlled subsystems in place even as the lumens of the collars are used for flow.

Figure 4:
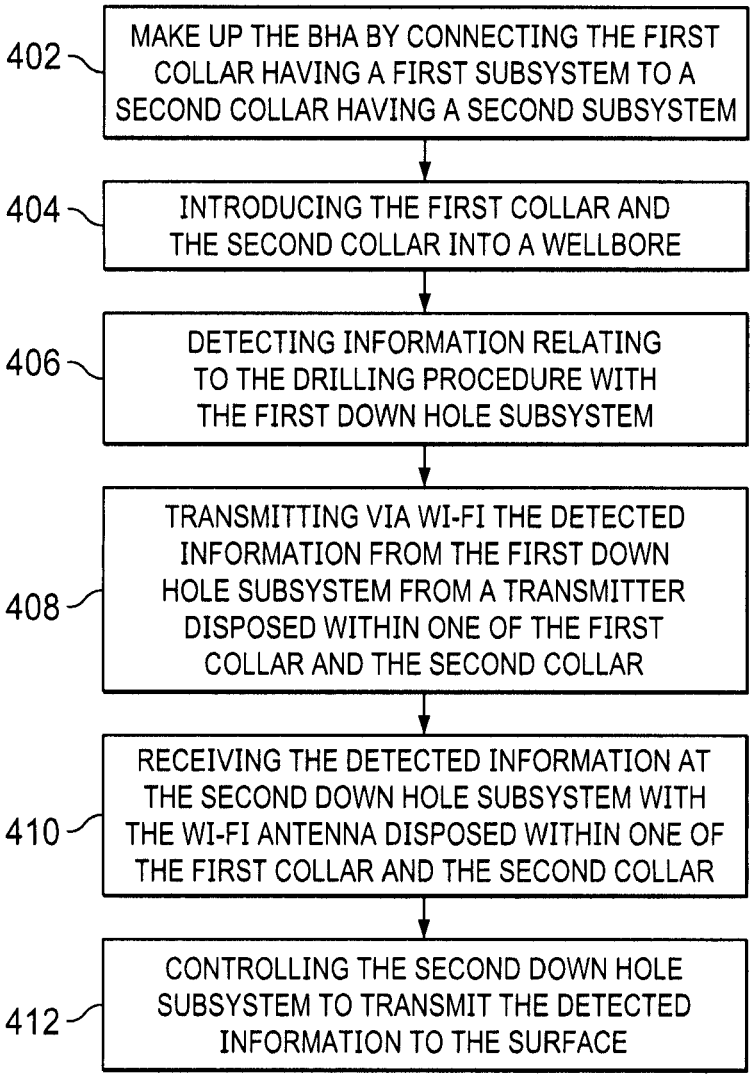
FIG. 4 is a flow chart diagram of at least a portion of a method according to one or more aspects of the present disclosure.

FIG. 4 describes an example implementation of a method of using the communication system 100, 200 in a down hole environment. With reference to FIG. 4, the method may begin at 402 with making up the BHA by connecting a first collar having a first electronically controlled subsystem to a second collar having a second electronically controlled subsystem. In this implementation, making up the BHA may include threading the first collar to the second collar. In some implementations, the first collar may include a chassis securing the first electronically controlled subsystem into the passage or lumen in the first collar. In some implementations, the inner surface of the first collar may be formed to receive and protect a portion of the electronically controlled subsystem to at least partially protect it from high-pressure fluid flow flowing through the lumen when in use. Likewise, in some implementations, the second collar may also include a chassis disposed in the lumen or in a surface in the lumen as described with reference to the first collar. The chassis and the second collar may secure the second electronically controlled subsystem in place. In implementations utilizing a alignment element, such as the alignment element 140, prior to threading the first collar to the second collar, users may connect the Wi-Fi communication link of the first electronically controlled subsystem to the Wi-Fi communication link of the second electronically controlled subsystem. Connecting these links may include securing them together in a way that prevents relative movement, without physically stabbing or electrically connecting the links together. Implementations that do not utilize an alignment element may make BHA makeup more efficient because affixing the links may not be required at all. Rather, the links may be secured in an inner wall of the collars via a chassis or other connector. Accordingly, the BHA may be made up by threading the first collar to the second collar without a step of separately attaching the communication links to each other.

At 404, the method may include introducing the first collar and the second collar forming a part of the BHA into a wellbore. Depending on the stage of the wellbore being made, this may include drilling down from the surface or may include tripping in to the borehole after BHA or bit maintenance or other maintenance.

At 406, with the BHA below the surface and operating a subterranean formation, the first electronically controlled subsystem may detect or obtain information relating to the borehole, the subterranean structure, the bit, the BHA, or other information. As this information is collected, it may be stored for communication via the Wi-Fi wet connect to the second electronically controlled subsystem through the lumens of the first and second collars. In some implementations, it may be transmitted immediately without storing. In some implementations, communication may occur while pressurized drilling mud flows through the lumens of the collars. In other implementations, communication may occur only after flow ceases, such as when a new stand is being added to the drill string.

At 408, the first electronically controlled subsystem transmits the detected or obtained information via Wi-Fi over its communication link forming a part of the Wi-Fi wet connect. At 410, the second electronically controlled subsystem receives at its communication link via the Wi-Fi wet connect the information transmitted via Wi-Fi from the first electronically controlled subsystem.

At 412, the first electronically controlled subsystem transmits the detected information to the surface. This transmission may occur using any method known in the art, including for example mud pulse telemetry. This is particularly helpful when for example the first electronically controlled subsystem is an RSS that does not have mud pulse telemetry capability, while the second electronically controlled subsystem is an MWD tool that does have mud pulse telemetry capability. By communicating information from the first electronically controlled subsystem via the Wi-Fi wet connect, the drilling communication system may allow the RSS to take advantage of the capabilities of the MWD tool.

The present disclosure introduces a drilling communication system that includes a first drilling collar, a second drilling collar, and a Wi-Fi wet connect. The first drilling collar may be sized and configured to accommodate flow of drilling mud, and may comprise a first downhole subsystem disposed therein. The first downhole subsystem may be configured and arranged to obtain information relating to drilling operation specifications, subterranean conditions, or measureable drilling conditions or parameters, in a downhole tool. The second drilling collar may be sized and configured to accommodate flow of drilling mud and may comprise a second downhole subsystem configured and arranged to handle the information obtained by the first downhole subsystem. The Wi-Fi wet connect may include a transmitter and a receiver, with the transmitter associated with the first downhole subsystem, and the receiver associated with the second downhole subsystem. The Wi-Fi wet connect may be configured to wirelessly communicate information from the first downhole subsystem to the second downhole subsystem.

In some aspects, the first drilling collar is threadably attached to the second drilling collar to form a portion of a bottom hole assembly. In some aspects, the first downhole subsystem may comprise at least one of the following: a Logging-While-Drilling (LWD) downhole subsystem configured to detect and log information relating to subterranean conditions, a Rotary Steerable System (RSS) downhole subsystem configured to communicate information relating to drilling operation specifications or measurable drilling conditions, or a mud motor downhole subsystem configured to communicate information relating to drilling operation specifications or measurable drilling conditions. In some aspects, the second downhole subsystem comprises a Measurement-While Drilling (MWD) downhole subsystem arranged to communicate information via mud pulse telemetry. In some aspects, the Wi-Fi wet connect comprises an alignment element securing the transmitter in place relative to the receiver. In some aspects, the alignment element is sealed to prevent the ingress or egress of fluids. In some aspects, the system may further include a receiver forming a part of the first downhole subsystem of the first collar and a transmitter forming a part of the second downhole subsystem of the second collar. The Wi-Fi wet connect may be configured to wirelessly communicate information from the second downhole subsystem to the first downhole subsystem. In some aspects, the Wi-Fi wet connect is disposed in a lumen of the first drilling collar and the second drilling collar is configured to accommodate the flow of drilling mud to a bottom hole assembly. In some aspects, the Wi-Fi wet connect is configured to communicate via RF signals in a range of about 0.001 GHz to about 30 GHz.

In some exemplary aspects, the present disclosure also introduces a drilling communication system that may include a first downhole subsystem configured and arranged to obtain information relating to drilling operation specifications, subterranean condition, or measureable drilling conditions or parameters, in a downhole tool. The drilling communication system may also include a second downhole subsystem configured and arranged to handle the information obtained by the first downhole subsystem. The drilling communication system may also include a Wi-Fi wet connect comprising a transmitter and a receiver arranged to enable communication of the obtained information between the first downhole subsystem and the second downhole subsystem, the transmitter being associated with the first downhole subsystem, the receiver being associated with the second downhole system, the transmitter and receiver being arranged to operate using VHF, UHF, or SHF frequencies.

In some aspects, the system may include a first drilling collar with the first downhole subsystem being disposed within the first drilling collar and may include a second drilling collar with the second downhole subsystem being disposed within the second drilling collar, the first drilling collar and threadably attached to the second drilling collar. In some aspects, the first downhole subsystem comprises at least one of the following: a Logging-While-Drilling (LWD) downhole subsystem configured to detect and log information relating to subterranean conditions, a Rotary Steerable System (RSS) downhole subsystem configured to communicate information relating to drilling operation specifications or measurable drilling conditions, or a mud motor downhole subsystem configured to communicate information relating to drilling operation specifications or measurable drilling conditions. In some aspects, the second downhole subsystem comprises a Measurement-While-Drilling (MWD) subsystem.

In some exemplary aspects, the present disclosure also introduces a method of communicating information collected in a wellbore that may include making up a bottom hole assembly (BHA) by connecting a first collar having a first subsystem to a second collar having a second subsystem; introducing the first collar and the second collar into a wellbore as a part of a drilling procedure; obtaining downhole information relating to the drilling procedure with the first downhole subsystem; transmitting via a Wi-Fi wet connect the obtained information from a first downhole subsystem carried by one of the first collar and the second collar; and receiving the obtained information at a second downhole subsystem carried by the other of the first collar and the second collar.

In some aspects, the method may include pumping drilling mud through a bore in the first collar and the second collar while the transmitter and the receiver are disposed within the bore. In some aspects, the second downhole subsystem is a MWD tool, the method comprising transmitting information to a surface using mud pulse telemetry. In some aspects, the method may include aligning the transmitter with the receiver using an alignment element. In some aspects, the method may include sealing an air volume between the transmitter and the receiver or RF transparent material. In some aspects, the first downhole subsystem is one of: a Logging While Drilling (LWD) tool configured to log information relating to subterranean formations; a rotary steering system configured to obtain information relating to operational parameters, or a drilling mud motor configured to obtain information relating to operational parameters.

In some exemplary aspects, the present disclosure also introduces a drilling communication system that may include a first drilling collar having a bore sized and configured to accommodate flow of drilling mud, the first drilling collar comprising a first downhole subsystem disposed therein, the first downhole subsystem configured and arranged to detect or obtain information relating to drilling operation specifications, subterranean condition, or measureable drilling conditions or parameters, in a downhole tool, the first downhole subsystem comprising a Wi-Fi transmitter disposed within the bore and configured to transmit the detected or obtained information. The system may also include a second drilling collar connectable to the first drilling collar, the second drilling collar having a bore sized and configured to accommodate flow of drilling mud, the second drilling collar comprising a second downhole subsystem configured and arranged to handle the information detected or obtained by the first downhole subsystem, the second downhole subsystem comprising a Wi-Fi receiver disposed within the bore and configured to receive the detected or obtained information transmitted by the Wi-Fi transmitter.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A drilling communication system, comprising:

a first drilling collar sized and configured to accommodate flow of drilling mud, the first drilling collar comprising a first downhole subsystem disposed therein, the first downhole subsystem configured and arranged to obtain information relating to drilling operation specifications, subterranean conditions, or measureable drilling conditions or parameters, in a downhole tool;

a second drilling collar sized and configured to accommodate flow of drilling mud, the second drilling collar comprising a second downhole subsystem configured and arranged to handle the information obtained by the first downhole subsystem; and a Wi-Fi wet connect comprising a transmitter and a receiver, the transmitter being associated with the first downhole subsystem, the receiver being associated with the second downhole subsystem, the Wi-Fi wet connect being configured to wirelessly communicate information from the first downhole subsystem to the second downhole subsystem, the Wi-Fi wet connect comprising a hollow tube-shaped alignment element disposable within a lumen of the first drilling collar or the second drilling collar, and configured to circumferentially receive the transmitter and secure the transmitter in place relative to the receiver within the alignment element, the alignment element being sealed to prevent the ingress or egress of fluids between the transmitter and the receiver.

2. The system of claim 1, wherein the first drilling collar is threadably attached to the second drilling collar to form a portion of a bottom hole assembly.

3. The system of claim 1, wherein the first downhole subsystem comprises at least one of the following:

a Logging-While-Drilling (L WD) downhole subsystem configured to detect and log information relating to subterranean conditions, a Rotary Steerable System (RSS) downhole subsystem configured to communicate information relating to drilling operation specifications or measurable drilling conditions, or a mud motor downhole subsystem configured to communicate information relating to drilling operation specifications or measurable drilling conditions.

4. The system of claim 3, wherein the second downhole subsystem comprises a Measurement-While Drilling (MWD) downhole subsystem arranged to communicate information via mud pulse telemetry.

5. The system of claim 1, the receiver forming a part of the first downhole subsystem of the first collar and the transmitter forming a part of the second downhole subsystem of the second collar, the Wi-Fi wet connect being configured to wirelessly communicate information from the second downhole subsystem to the first downhole subsystem.

6. The system of claim 1, wherein the Wi-Fi wet connect is disposed in a lumen of the first drilling collar and the second drilling collar is configured to accommodate the flow of drilling mud to a bottom hole assembly.

7. The system of claim 1, wherein the Wi-Fi wet connect is configured to communicate via RF signals in a range of about 0.001 GHz to about 30 GHz.

8. A drilling communication system, comprising:

a first downhole subsystem configured and arranged to obtain information relating to drilling operation specifications, subterranean condition, or measureable drilling conditions or parameters, in a downhole tool;

a second downhole subsystem configured and arranged to handle the information obtained by the first downhole subsystem; and a Wi-Fi wet connect comprising a transmitter and a receiver arranged to enable communication of the obtained information between the first downhole subsystem and the second downhole subsystem, the transmitter being associated with the first downhole subsystem, the receiver being associated with the second downhole system, the transmitter and receiver being arranged to operate using VHF, UHF, or SHF frequencies, the Wi-Fi wet connect comprising a hollow tube-shaped alignment element disposable within a lumen of the first drilling collar or the second drilling collar, and configured to circumferentially receive the transmitter and secure the transmitter in place relative to the receiver within the alignment element, the alignment element being sealed to prevent the ingress or egress of fluids between the transmitter and the receiver.

9. The system of claim 8, further comprising:

a first drilling collar, the first downhole subsystem being disposed within the first drilling collar; and a second drilling collar, the second downhole subsystem being disposed within the second drilling collar, the first drilling collar and threadably attached to the second drilling collar.

10. The system of claim 8, wherein the first downhole subsystem comprises at least one of the following:

a Logging-While-Drilling (LWD) downhole subsystem configured to detect and log information relating to subterranean conditions, a Rotary Steerable System (RSS) downhole subsystem configured to communicate information relating to drilling operation specifications or measurable drilling conditions, or a mud motor downhole subsystem configured to communicate information relating to drilling operation specifications or measurable drilling conditions.

11. The system of claim 10, wherein the second downhole subsystem comprises a Measurement-While-Drilling (MWD) subsystem.

12. A method of communicating information collected in a wellbore, comprising:

making up a bottom hole assembly (BHA) by connecting a first collar having a first subsystem to a second collar having a second subsystem, the making up comprising circumferentially receiving a transmitter and a receiver in a hollow alignment element, aligning the transmitter and the receiver within the alignment element, and sealing an air volume between the transmitter and the receiver within the alignment element;

introducing the first collar and the second collar into a well bore as a part of a drilling procedure;

obtaining downhole information relating to the drilling procedure with the first downhole subsystem;

transmitting via a Wi-Fi wet connect the obtained information from a first downhole subsystem carried by one of the first collar and the second collar; and receiving the obtained information at a second downhole subsystem carried by the other of the first collar and the second collar.

13. The method of claim 12, comprising pumping drilling mud through a bore in the first collar and the second collar while the transmitter and the receiver are disposed within the bore.

14. The method of claim 12, wherein the second downhole subsystem is a MWD tool, the method comprising transmitting information to a surface using mud pulse telemetry.

15. The method of claim 12, wherein the first downhole subsystem is one of:

a Logging While Drilling (L WD) tool configured to log information relating to subterranean formations;

a rotary steering system configured to obtain information relating to operational parameters, or a drilling mud motor configured to obtain information relating to operational parameters.

16. A drilling communication system, comprising:

a first drilling collar having a bore sized and configured to accommodate flow of drilling mud, the first drilling collar comprising a first downhole subsystem disposed therein, the first downhole subsystem configured and arranged to detect or obtain information relating to drilling operation specifications, subterranean condition, or measureable drilling conditions or parameters, in a downhole tool, the first downhole subsystem comprising a Wi-Fi transmitter disposed within the bore and configured to transmit the detected or obtained information;

a second drilling collar connectable to the first drilling collar, the second drilling collar having a bore sized and configured to accommodate flow of drilling mud, the second drilling collar comprising a second downhole subsystem configured and arranged to handle the information detected or obtained by the first downhole subsystem, the second downhole subsystem comprising a Wi-Fi receiver disposed within the bore and configured to receive the detected or obtained information transmitted by the Wi-Fi transmitter; and a hollow tube-shaped alignment element disposable within a lumen of the first drilling collar or the second drilling collar, and configured to circumferentially receive the transmitter and secure the Wi-Fi transmitter in place relative to the Wi-Fi receiver within the alignment element, the alignment element being sealed to prevent the ingress or egress of fluids between the Wi-Fi transmitter and the Wi-Fi receiver.

* * * * *